US008496243B2

(12) United States Patent
Nishioka

(10) Patent No.: US 8,496,243 B2
(45) Date of Patent: Jul. 30, 2013

(54) SHEET WIDTH REGULATING DEVICE AND IMAGE FORMING APPARATUS WITH SHEET WIDTH REGULATING DEVICE

(75) Inventor: Nobuhiro Nishioka, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/370,587

(22) Filed: Feb. 10, 2012

(65) Prior Publication Data

US 2012/0205859 A1 Aug. 16, 2012

(30) Foreign Application Priority Data

Feb. 14, 2011 (JP) ..... 2011-028430

(51) Int. Cl.
*B65H 1/00* (2006.01)

(52) U.S. Cl.
USPC ..... 271/171

(58) Field of Classification Search
USPC ..... 271/171; 399/393
See application file for complete search history.

(56) References Cited

U.S. PATENT DOCUMENTS

| | | | | |
|---|---|---|---|---|
| 5,611,528 | A * | 3/1997 | Nakamura et al. | 271/164 |
| 7,331,577 | B2 * | 2/2008 | Park | 271/171 |
| 2003/0193130 | A1 | 10/2003 | Park | |
| 2007/0114713 | A1 | 5/2007 | Yonemoto | |
| 2008/0251996 | A1 | 10/2008 | Ubayashi | |
| 2010/0133743 | A1 | 6/2010 | Hamasaki et al. | |

* cited by examiner

*Primary Examiner* — Michael McCullough
(74) *Attorney, Agent, or Firm* — Gerald E. Hespos; Michael J. Porco; Matthew T. Hespos

(57) ABSTRACT

A sheet width regulating device includes a base plate, a regulating member, a first moving cursor, a first guiding portion, a second guiding portion, a first guidable portion, a second guidable portion, and a synchronizing member. The regulating member regulates one end of the sheet. The first moving cursor regulates the other end of the sheet, and is movable in the way perpendicular to a direction along the other end of the sheet that the first guiding portion extends. The second guiding portion extends in parallel with the first guiding portion. The first guidable portion is attached to the first moving cursor and guided by the first guiding portion. The second guidable portion is attached to the first moving cursor and guided by the second guiding portion. The synchronizing member synchronizes a movement of the first guidable portion and the second guidable portion.

10 Claims, 12 Drawing Sheets

SHEET WIDTH REGULATING DEVICE AND IMAGE FORMING APPARATUS WITH SHEET WIDTH REGULATING DEVICE

INCORPORATION BY REFERENCE

This application is based on and claims the benefit of priority from Japanese patent application No. 2011-028430, filed in Japan Patent Office on Feb. 14, 2011, the contents of which are hereby incorporated by reference.

BACKGROUND

The present disclosure relates to a sheet width regulating device for aligning the orientation of various sheets such as a sheet width regulating device mainly used to align the orientation of a sheet or a document for image formation in an image forming apparatus such as a copier, a facsimile machine or a printer or a sheet width regulating device used to align the orientation of a document in a scanner apparatus which does not perform image formation. The present disclosure also relates to an image forming apparatus with this sheet width regulating device.

Conventionally, there has been known an image forming apparatus with a sheet cassette of a center registration type which is detachably mounted into an apparatus main body and stores sheets to be fed to the apparatus main body. Such a conventional sheet cassette includes a pair of cursors for regulating the width of sheets stored in the sheet cassette and the sheets are positioned in a width direction by these cursors.

Since the cursors need to be so aligned that a direction of sheets conforms to a feeding direction, they have a certain length along the sheet feeding direction. Such cursors normally have, for example, a length of about 20 cm to 30 cm along the sheet feeding direction. The cursors are so designed that a user can parallelly move them in a direction perpendicular to the sheet feeding direction while holding them by hands.

However, since the cursors have a certain length as described above, forces act on the cursors in a nonuniform manner depending on how the user moves the cursors, for example, when the user moves the cursors while holding ends of the cursors. Thus, the cursors may be inclined with respect to the sheet feeding direction.

An object of the present disclosure is to provide a sheet width regulating device which reduces a possibility of inclining cursors and an image forming apparatus using this.

SUMMARY

One aspect of the present disclosure is directed to a sheet width regulating device, including a base plate, a regulating member, a first moving cursor, a first guiding portion, a second guiding portion, a first guidable portion, a second guidable portion, and a synchronizing member. A sheet having one end and the other end parallel to each other is to be placed on the base plate. The regulating member regulates one end of the sheet. The first moving cursor is a member for regulating the other end of the sheet, stands on the upper surface of the base plate and is movable in a way perpendicular to a direction along the other end of the sheet. The first guiding portion extends in the way on the upper surface of the base plate. The second guiding portion is spaced apart from and extends in parallel with the first guiding portion on the upper surface of the base plate. The first guidable portion is attached to the first moving cursor and guided by the first guiding portion. The second guidable portion is attached to the first moving cursor and guided by the second guiding portion. The synchronizing member synchronizes a movement of the first guidable portion guided by the first guiding portion and a movement of the second guidable portion guided by the second guiding portion.

These and other objects, features and advantages of the present invention will become more apparent upon reading the following detailed description along with the accompanying drawings.

DETAILED DESCRIPTION

Figure 1:
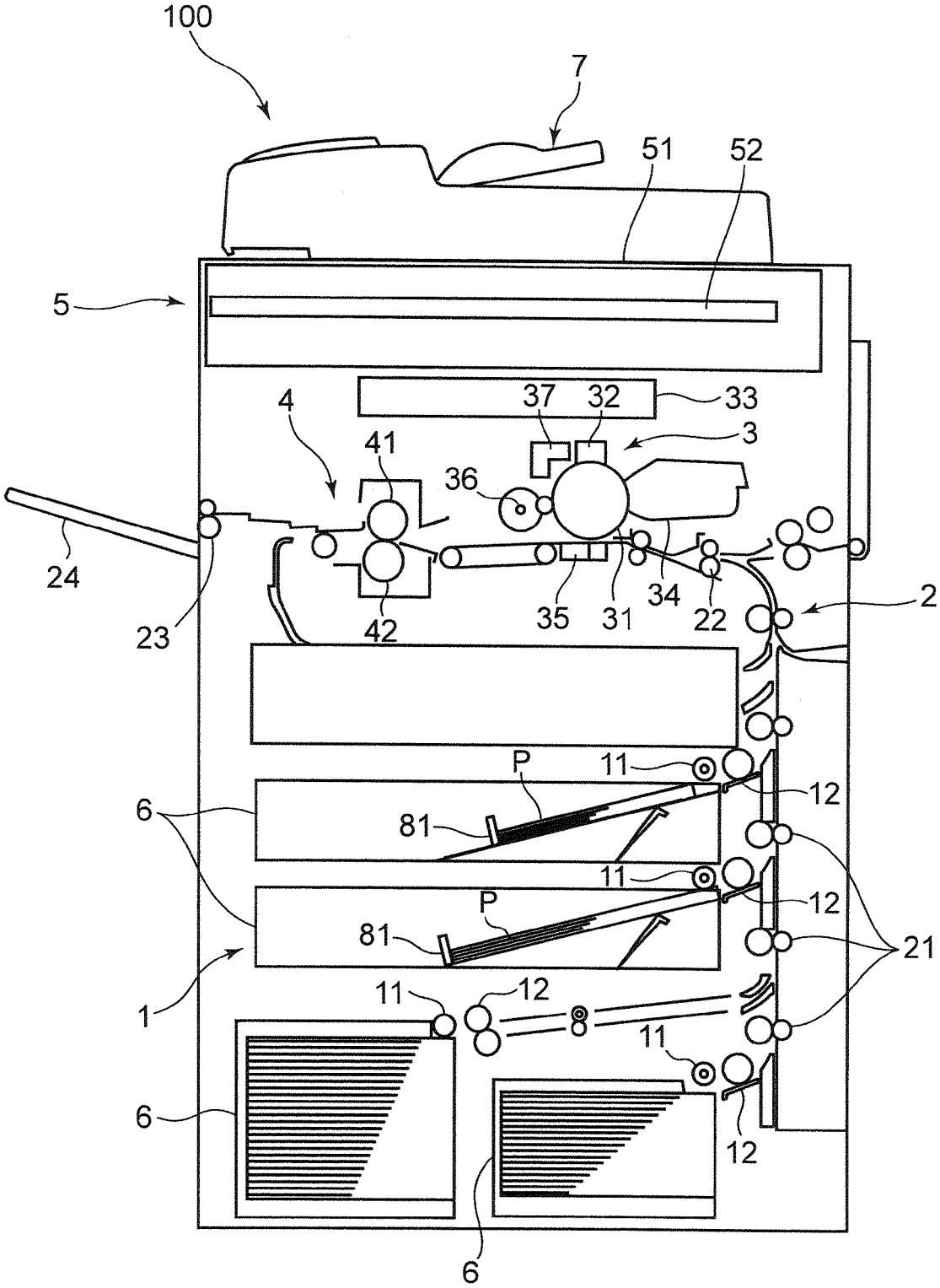
FIG. 1 is a schematic sectional view of a copier showing the entire construction of the copier according to one embodiment of the present disclosure.

Hereinafter, an embodiment according to the present disclosure is described based on the drawings. Note that, in respective figures, members denoted by the same reference numerals are indicated to be the same members and not repeatedly described. FIG. 1 is a schematic sectional view showing the entire construction of a copier according to one embodiment of the present disclosure. FIGS. 2 to 12 are views showing essential constructions of a sheet cassette of the copier shown in FIG. 1. Note that arrows F and R in FIGS. 2 to 5 respectively indicate a device front side (F) and a device rear side (R) when the sheet cassette is mounted in the copier. First, with reference to FIG. 1, the entire construction of the copier 100 according to one embodiment of the present disclosure is described.

The copier 100 of this embodiment is a center registration type copier and includes a sheet feeding unit 1 arranged in a lower part of an apparatus main body, a sheet conveying unit 2 arranged lateral to and above the sheet feeding unit 1, an image forming unit 3 arranged above the sheet conveying unit 2, a fixing unit 4 arranged downstream of the image forming unit 3 in a sheet conveying direction, an image reading unit 5 arranged above the image forming unit 3 and the fixing unit 4 and including optical members and the like, and an automatic document feeder (ADF) 7 openably and closably arranged on the image reading unit 5.

The sheet feeding unit 1 is such that sheets P in a sheet stack stored in each sheet cassette 6 detachably mounted in the apparatus main body are fed to an exit side (right side in FIG. 1) of the sheet cassette 6 by the rotation of a cylindrical feed roller 11 and separated by a separating unit 12 provided above the exit side of each sheet cassette 6, whereby the sheets P can be reliably fed one by one to the sheet conveying unit 2 from the uppermost one. Note that this copier 100 is so constructed that mounting and detaching directions of the sheet cassettes 6 into and from the apparatus main body are substantially perpendicular to a feeding direction of the sheets P from the sheet cassettes 6 to the apparatus main body.

Note that the sheets P are examples of sheets. Sheets may be, for example, OHP films or the like.

The sheet conveying unit 2 conveys the sheet P fed from the sheet feeding unit 1 toward the image forming unit 3 by pairs of conveyor rollers 21 and a pair of registration rollers 22 and further discharges the sheet P having an image formed thereon in the image forming unit 3 and the fixing unit 4 onto a discharge tray 24 by a pair of discharge rollers 23.

The image forming unit 3 forms a predetermined toner image on a sheet P by an electrophotographic process. The image forming unit 3 includes a photoconductive drum 31 rotatably supported and having a photoconductive property and a charging unit 32, an exposure unit 33, a developing unit 34, a transfer unit 35, a cleaner 36 and a charge removing unit 37 arranged around the photoconductive drum 31.

The charging unit 32 includes a charging wire to which a high voltage is to be applied. The charging unit 32 gives a predetermined potential to the surface of the photoconductive drum 31 by corona discharge from this charging wire. The exposure unit selectively removes the potential of the surface of the photoconductive drum 31 and forms an electrostatic latent image on the surface of the photoconductive drum 31 by irradiating the photoconductive drum 31 with a laser beam output from a laser emitter via a polygon mirror and a reflecting mirror based on image data of a document read by the image reading unit 5 to be described later.

The developing unit 34 develops the electrostatic latent image by toner to form a toner image on the surface of the photoconductive drum 31. The transfer unit 35 transfers the toner image on the surface of the photoconductive drum 31 to a sheet P. In this copier, the transfer unit 35 includes a transfer roller arranged at a predetermined distance from the photoconductive drum 31. The cleaner 36 removes the toner remaining on the surface of the photoconductive drum 31 after image transfer. The charge removing unit 37 removes electric charges remaining on the surface of the photoconductive drum 31.

The fixing unit 4 is arranged downstream of the image forming unit 3 in the sheet conveying direction and fixes a toner image to a sheet P by heating the sheet P having the toner image transferred thereto in the image forming unit 3 while sandwiching it between a heating roller 41 and a pressure roller 42.

The image reading unit 5 irradiates a document placed on a contact glass 51 with light from an exposure lamp. Then, the image reading unit 5 introduces the reflected light of the irradiated light into a photoelectric converter composed of a CCD line sensor and the like via a reflecting mirror, thereby reading document image information. Note that the exposure lamp and the reflecting mirror form a scanning section of the image reading unit 5 and this scanning section moves a moving area 52 extending in a lateral direction of FIG. 1 at a predetermined speed, whereby the entire surface of the document placed on the contact glass 51 can be scanned to read an image on the entire document surface.

Next, the construction of the above sheet cassette 6 is described in detail with reference to FIGS. 2 to 12.

The sheet cassette 6 includes a tray frame 61 and a sheet tray 62 mounted by being placed on the tray frame 61. The tray frame 61 is detachably mounted into the apparatus main body via a sliding mechanism 61*a*. If a user pulls a handle formed on a front cover 61*b* of the tray frame 61, the sliding mechanism 61*a* slides and the sheet cassette 6 can be pulled out forward. The user places sheets P on the sheet tray 62 of the sheet cassette 6 pulled out in this way.

Figure 2:
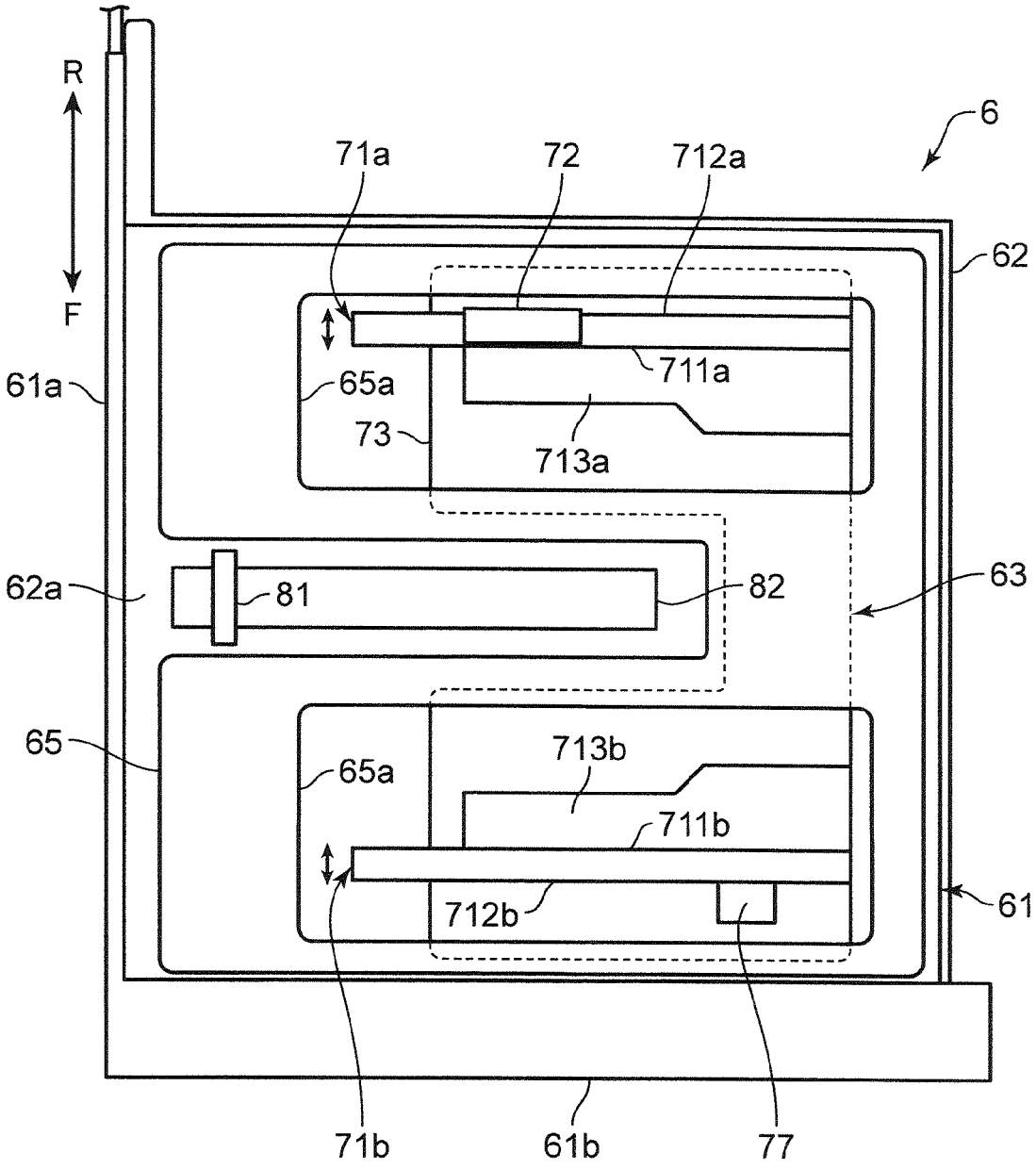
FIG. 2 is a plan view of a sheet cassette provided in the copier of FIG. 1.

As shown in FIG. 2, the sheet tray 62 includes a sheet storing portion 62*a* in the form of a recess in which the sheets P can be stacked and stored. A sheet width regulating unit 63 for regulating a width direction (direction perpendicular to the sheet conveying direction) of the sheets P, a length cursor 81 for regulating a length direction of the sheets P and a length cursor rail member 82 for supporting the length cursor 81 are arranged at the bottom of the sheet storing portion 62*a*. A predetermined sheet position corresponding to the size of the sheets P is regulated by the sheet width regulating unit 63 and the length cursor 81. The sheet width regulating unit 63 corresponds to an example of a sheet width regulating device.

The length cursor 81 is slidable in the length direction of the sheets P on the length cursor rail member 82. The sheet position in the length direction (direction along the sheet feeding direction) of the sheets P is regulated by this length cursor 81 and the inner wall surface (right inner wall surface in FIG. 2) of the sheet tray 62 facing the length cursor 81.

A substantially plate-like lifting member 65 which lifts the leading end of the sheet P in the feeding direction to bring it into contact with the feed roller 11 is provided above the sheet width regulating unit 63. The lifting member 65 is provided with a cutout formed to avoid the length cursor 81 and the length cursor rail member 82, and the length cursor 81 projects from the upper surface of the lifting member 65 through this cutout.

Further, the lifting member 65 is provided with two openings 65*a*. Width cursors 71*a*, 71*b* on a base plate 71 to be described later project from the upper surface of the lifting member 65 through these two openings 65*a*.

The lifting member 65 is in the form of a flat plate which can cover the bottom surface of the sheet tray 62 without interfering with sliding movements of the respective cursors 71*a*, 71*b* and 81. The opposite front and rear ends of the back side (left side of FIG. 2) of the lifting member 65 in the sheet feeding direction are respectively rotatably supported by unillustrated pins mounted on front and rear side surface portions of the sheet tray 62, whereby an exit side (right side of FIG. 2) of the lifting member 65 in the sheet feeding direction can be raised and lowered relative to the bottom surface of the sheet tray 62.

Figure 3:
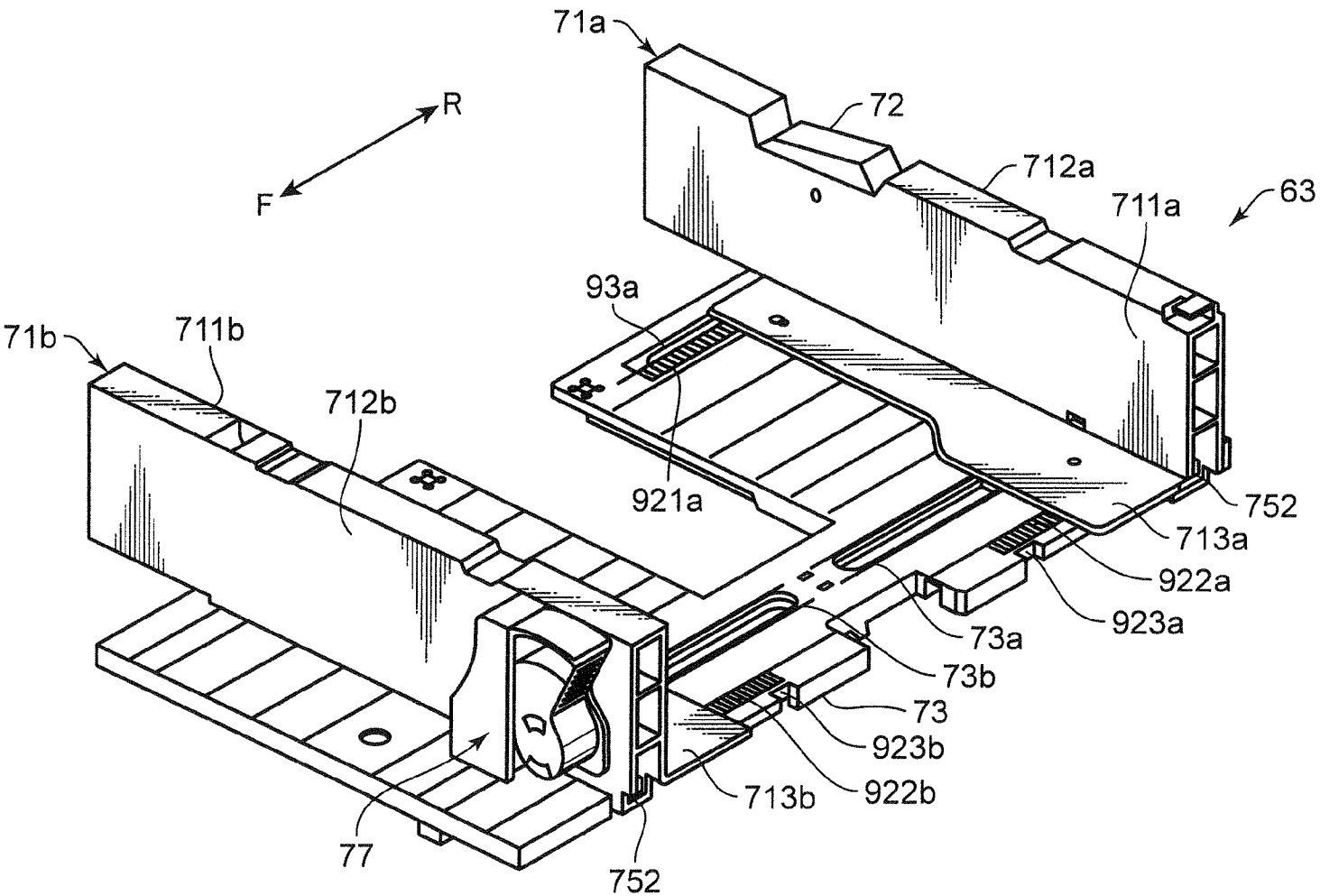
FIG. 3 is a perspective view showing a sheet width regulating unit provided in the sheet cassette of FIG. 2 when viewed from above.
Figure 4:
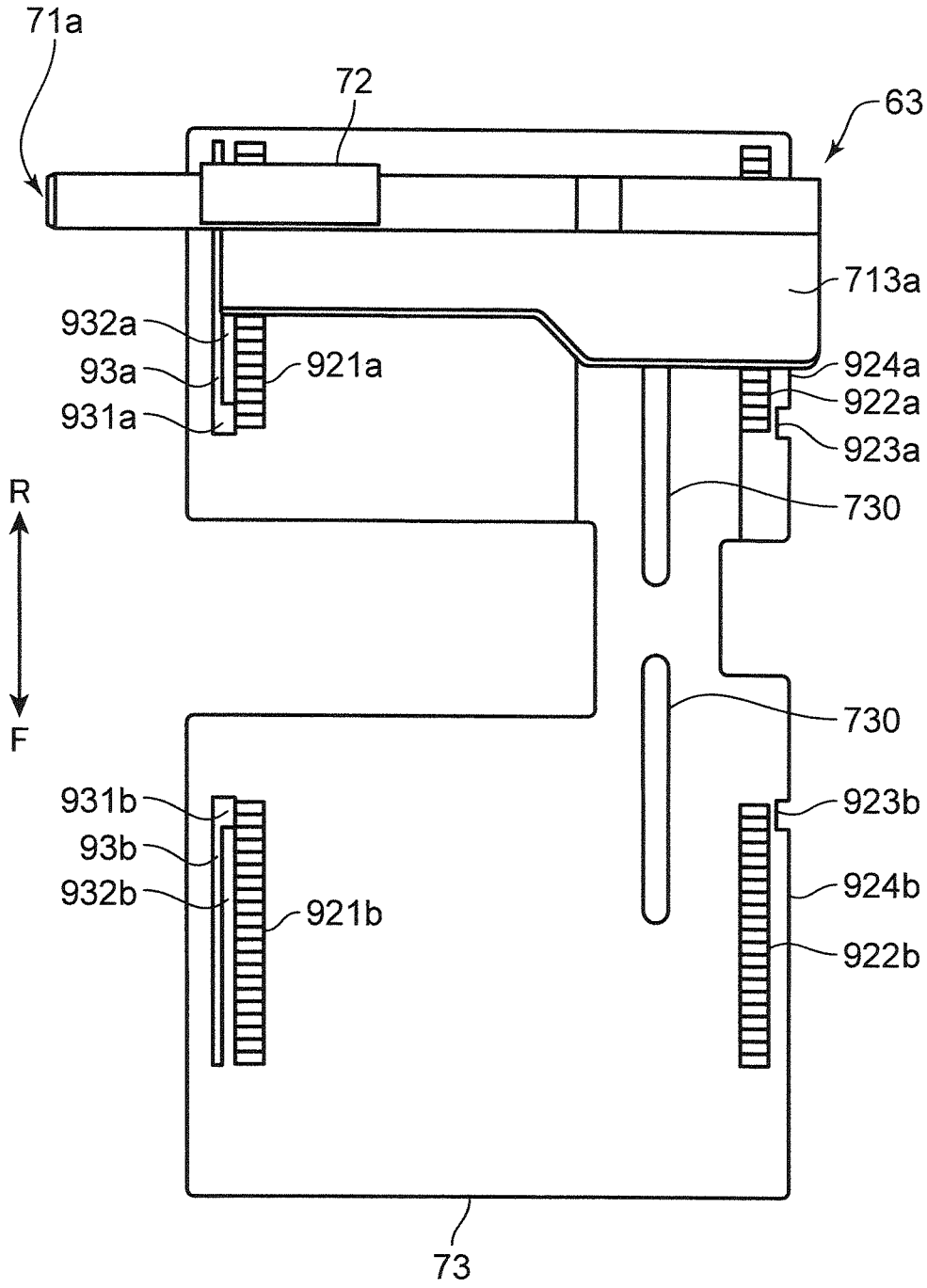
FIG. 4 is a plan view showing the sheet width regulating unit of FIG. 3 with one width cursor removed.
Figure 5:
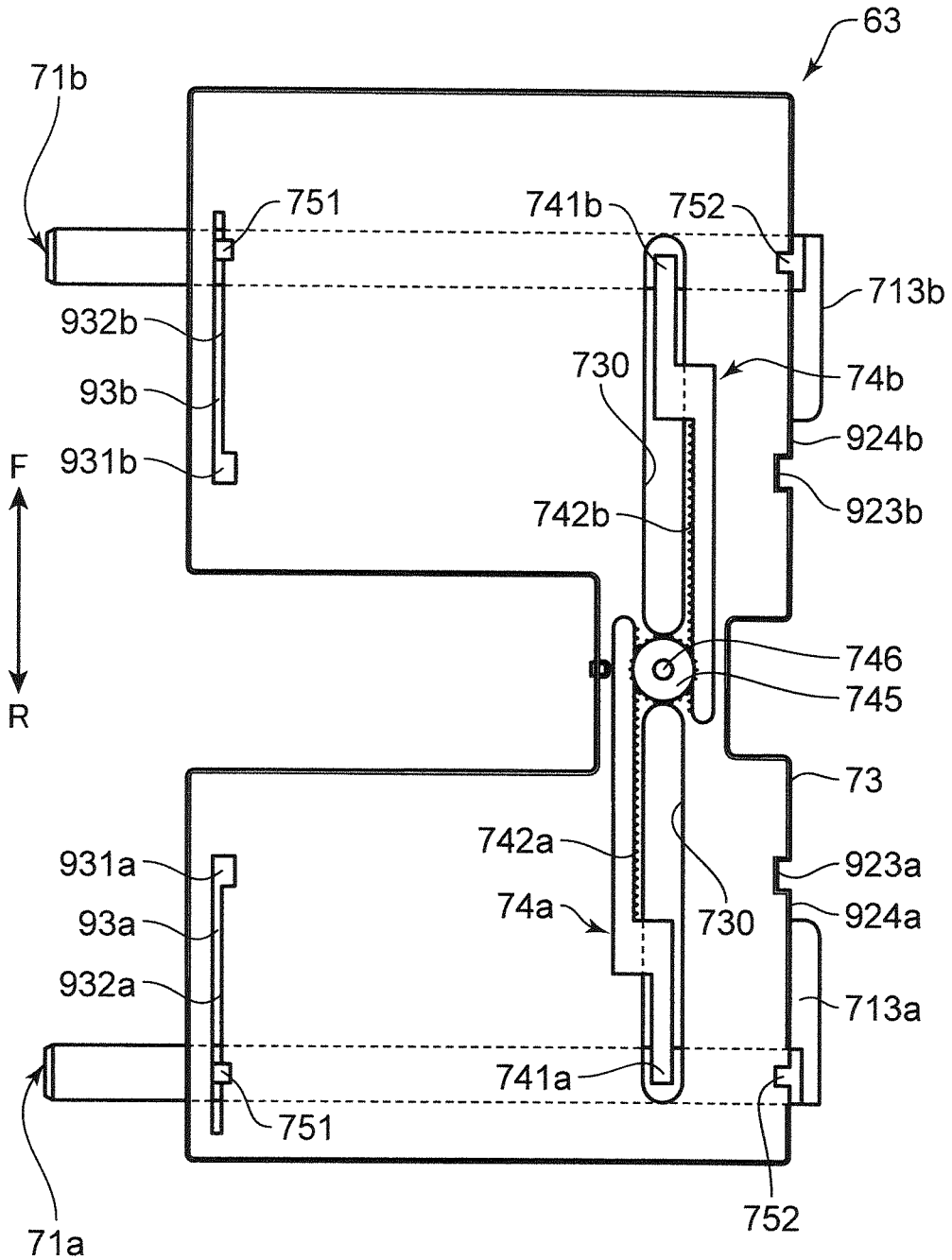
FIG. 5 is a bottom view of the sheet width regulating unit of FIG. 3.

FIG. 3 is a perspective view showing the sheet width regulating unit 63 when viewed from above. FIG. 4 is a plan view showing the sheet width regulating unit 63 with the width cursor 71*b* removed. FIG. 5 is a bottom view of the sheet width regulating unit 63.

The sheet width regulating unit 63 includes the pair of width cursors 71*a*, 71*b* for regulating the width direction of the sheets P, the base plate 73 slidably supporting this pair of width cursors 71*a*, 71*b*, racks 74*a*, 74*b* and a pinion 745 (FIG. 5) as an example of a moving mechanism for moving the pair of width cursors 71*a*, 71*b* in tandem, and a stopper member 77 (FIG. 3) for specifying the position of the width cursor 71*b* relative to the base plate 73 by being mounted on the front width cursor 71*b*. Note that although the front width cursor 71*b* and the rear width cursor 71*a* are shown as examples of a first and a second moving cursors of the present disclosure, only one of the front and rear width cursors may be made movable and the other may be fixed without providing the above moving mechanism. In this case, the fixed width cursor corresponds to an example of a regulating member.

Either one of the front and rear width cursors 71*b*, 71*a* may not be provided and the inner wall surface of the tray frame 61 may be used as a regulating member. For example, in the case of not providing the front width cursor 71*b*, the inner wall surface of the tray frame 61 facing a wall 711*a* of the rear width cursor 71*a* serves as the regulating member. For example, in the case of not providing the rear width cursor 71*a*, the inner wall surface of the tray frame 61 facing a wall 711*b* of the front width cursor 71*b* serves as the regulating member.

The stopper member 77 includes an unillustrated engaging claw which is engaged with, for example, an unillustrated engaging portion formed on the upper surface of the base plate 73. By engaging this engaging claw with the engaging portion of the base plate 73, the stopper member 77 fixes the position of the width cursor 71*b* to the base plate 73.

The above pair of width cursors 71*a*, 71*b* are slidable in the width direction of the sheets P on the base plate 73 and move away from or toward each other by means of the racks 74*a*, 74*b* and the pinion 745, thereby widening or narrowing a distance (width) of the both width cursors 71*a*, 71*b*.

Further, the respective width cursors 71*a*, 71*b* include housings in the form of boxes having predetermined height, length and width. Further, plate-like horizontal portions 713*a*, 713*b* horizontally extending toward the other width cursors are connected to bottom parts of the width cursors 71*a*, 71*b*.

The housing of the width cursor 71*a* includes walls 711*a*, 712*a* extending in the feeding direction of the sheets P. The width cursor 71*b* includes walls 711*b*, 712*b* extending in the feeding direction of the sheets P. The inner (facing sides of the width cursors 71*a*, 71*b*) surfaces of the walls 711*a*, 711*b* of the width cursors 71*a*, 71*b* come into contact with the sheets P to regulate the width of the sheets P.

The horizontal portions 713*a*, 713*b* support parts of the sheets P near the lateral edges from below, whereby the sheets P can be stored in order.

As shown in FIG. 5, the pair of racks 74*a*, 74*b* are arranged on the lower surface of the base plate 73 with rack tooth portions 742*a*, 742*b* faced toward each other. The racks 74*a*, 74*b* are mounted to lower parts of the respective width cursors 71*a*, 71*b* by mounting portions 741*a*, 741*b*. The base plate 73 is formed with a pair of guide long holes 730 extending in the direction perpendicular to the feeding direction of the sheets P. The mounting portions 741*a*, 741*b* connect the width cursors 71*a*, 71*b* arranged on the upper surface of the base plate 73 and the racks 74*a*, 74*b* arranged on the lower surface of the base plate 73 through the pair of guide long holes 730. Further, the pinion 745 engaged with the respective rack tooth portions 742*a*, 742*b* is provided between the pair of guide long holes 730. Note that the racks 74*a*, 74*b* may be integrally formed to the respective width cursors 71*a*, 71*b*.

The pinion 745 is rotatably supported about a boss 746 by inserting the boss 746 integrally formed to the base plate 73 into a boss insertion hole of the pinion 745.

According to a linking structure of the sheet width regulating unit 63, when the user moves one width cursor (e.g. front width cursor 71*b*), a drive force resulting from this movement is transmitted to a tooth portion of the pinion 745 via the rack tooth portion 742*b* of the rack 74*b* connected to the width cursor 71*b*, whereby the pinion 745 rotates about the boss 746. Further, a drive force resulting from this rotation is transmitted to the rack 74*a* via the rack tooth portion 742*a* engaged with the pinion 745, whereby the rack 74*a* moves by the same amount in a direction opposite to the moving direction of the rack 74*b*. As a result, by operating only one width cursor (front width cursor 71*b*), the other width cursor (rear width cursor 71*a*) moves by the same amount in the opposite direction in tandem with the movement of the one width cursor.

According to this construction, when the user moves one cursor to bring it into contact with ends of sheets, the other cursor also moves in tandem to hold the sheets between the two cursors. Thus, the sheets can be easily positioned at a center position and user operability is improved.

As shown in FIGS. 3 and 4, racks 921*a*, 921*b* (first rack) extending in the direction perpendicular to the feeding direction of the sheets P and racks 922*a*, 922*b* (second rack) extending in the direction perpendicular to the feeding direction, i.e. in parallel with the racks 921*a*, 921*b* at positions spaced apart from the racks 921*a*, 921*b* in the feeding direction of the sheets P are provided on the upper surface of the base plate 73.

A gear tooth pitch of the racks 921*a*, 921*b* and that of the racks 922*a*, 922*b* are set to be equal. Note that the racks 921*a*, 921*b* may be integrally formed to the base plate 73.

Further, the base plate 73 is formed with a guide long hole 93*a* (slit) extending in parallel with the rack 921*a* near the rack 921*a* and a guide long hole 93*b* (slit) extending in parallel with the rack 921*b* near the rack 921*b*.

According to this construction, since a sliding direction of the first moving cursor is regulated by the slit, the moving cursor can be easily moved in one direction while a first guidable portion is guided by a first guiding portion.

A wide enlarged portion 931*a* is formed at one end of the guide long hole 93*a*, and a wide enlarged portion 931*b* is formed at one end of the guide long hole 93*b*. Further, cutouts 923*a*, 923*b* are formed at positions respectively facing the enlarged portions 931*a*, 931*b* at downstream edge portions 924*a*, 924*b* of the base plate 73 in the sheet feeding direction.

Figure 6:
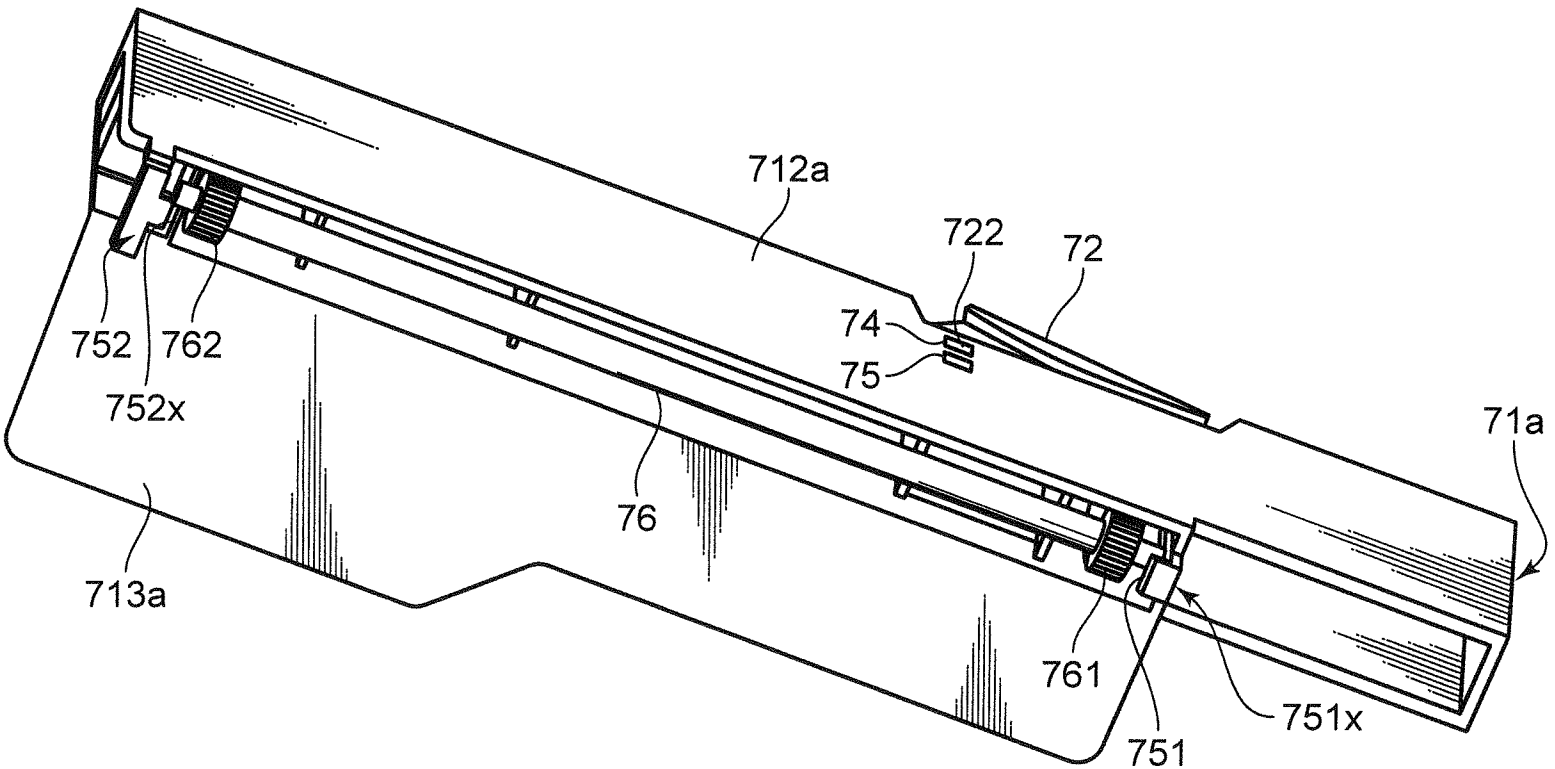
FIG. 6 is a perspective view of the width cursor when viewed from below.
Figure 7:
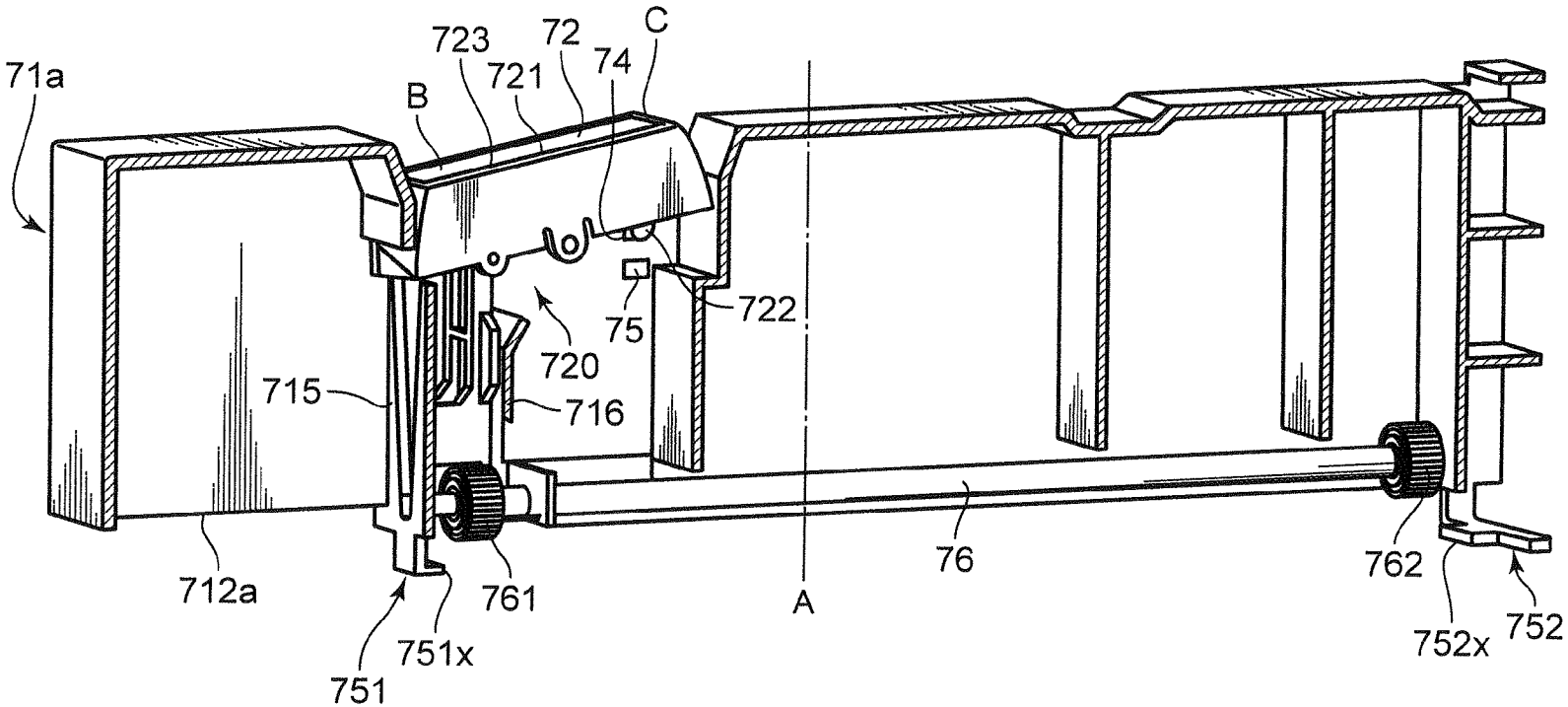
FIG. 7 is a perspective view showing the interior of the width cursor with one wall removed.

FIG. 6 is a perspective view of the width cursor 71*a* when viewed from below. FIG. 7 is a view showing the interior of the width cursor 71*a* with the wall 711*a* removed. Note that the width cursor 71*b* is not described since being constructed substantially similarly to the width cursor 71*a* except in not including a locking portion 720 to be described later, but including the stopper member 77.

A coupling shaft 76 is supported between the walls 711*a*, 712*a* in parallel with the walls 711*a*, 712*a* and the upper surface of the base plate 73 in a lower part of the width cursor 71*a*. A pinion 761 (first pinion) is coaxially and fixedly mounted on the coupling shaft 76 near one end, and a pinion 762 (second pinion) is coaxially and fixedly mounted on the coupling shaft 76 near the other end. In this way, the pinions 761, 762 are coupled by the coupling shaft 76 and coaxially rotated in tandem. Diameters and tooth numbers (pitches) of the pinions 761, 762 are equal to each other.

The locking portion 720 for locking the rotation of the pinion 761 about the coupling shaft 76 is arranged above the pinion 761.

Further, an engaging portion 751 (first engaging portion) projecting downward near the pinion 761 and an engaging portion 752 (second engaging portion) projecting downward at a downstream end of the width cursor 71*a* in the sheet feeding direction are provided at the bottom of the width cursor 71*a*. Projections 751*x*, 752*x* projecting toward each other along the sheet feeding direction are provided at the leading ends of the engaging portions 751, 752.

When the projections 751*x*, 752*x* are positioned in the enlarged portion 931*a* and the cutout 923*a* of the base plate 73 and the width cursor 71*a* is mounted on the base plate 73, the lower surface of the width cursor 71*a* is held in contact with the upper surface of the base plate 73, the pinions 761, 762 are engaged with the racks 921*a*, 922*a* and further the projections 751*x*, 752*x* project on the lower surface of the base plate 73.

When the width cursor 71*a* is slid in a direction of an arrow R in this state, the projection 751*x* enters an end of the guide long hole 93*a* and is engaged to embrace an edge portion 932*a* which is an edge portion of the base plate 73. Further, the projection 752*x* is engaged to embrace an edge portion 924*a* of the base plate 73.

Further, when the width cursor 71*a* is slid, the pinions 761, 762 move on the racks 921*a*, 922*a*, with the result that the pinions 761, 762 are rotated according to their movements on the racks 921*a*, 922*a*. At this time, since the pinions 761, 762 are fixedly coupled by the coupling shaft 76, a rotation amount of the pinion 761 and that of the pinion 762 are naturally equal.

Further, the diameters and tooth pitches of the pinions 761, 762 are set to be equal and the gear tooth pitch of the rack 921*a* and that of the rack 922*a* are set to be equal. Accordingly, if the rotation amount of the pinion 761 and that of the pinion 762 are equal, a sliding amount of the width cursor 71*a* at the position of the pinion 761 and that of the width cursor 71*a* at the position of the pinion 762 are equal. Then, the width cursor 71*a* parallelly moves, wherefore there is no possibility of inclining the cursor with respect to the sheet feeding direction.

According to this construction, when the user slides the first moving cursor in one direction, the first and second racks engaged with the first and second pinions relatively move, wherefore the first and second pinions rotate. At this time, since the first and second pinions are rotated coaxially and in tandem by the coupling shaft, the rotation amounts of the first and second pinions are equal. Thus, movement amounts of the first and second pinions on the base plate on which the first and second racks are provided become equal. Since the first and second pinions are attached to the moving cursor while being spaced apart, the moving cursor parallelly moves if the movement amounts of the first and second pinions on the base plate are equal. As a result, a possibility of inclining the cursor can be reduced.

At this time, since the projection 751*x* is engaged to embrace the edge portion 932*a* and the projection 752*x* is engaged to embrace the edge portion 924*a*, it is prevented that the width cursor 71*a* is lifted from the base plate 73 during a sliding movement. As a result, the racks 921*a*, 922*a* and the pinions 761, 762 are kept engaged and there is no gear slippage during the sliding movement. In this way, a possibility of including the cursor due to slippage between the racks 921*a*, 922*a* and the pinions 761, 762 can be reduced.

According to this construction, the first moving cursor is slidably engaged with the base plate near the first guiding portion and a second guiding portion. As a result, separation of the first and second guiding portions and the first and second guidable portions is prevented. As a result, the first and second guidable portions are reliably guided by the first and second guiding portions, wherefore reliability of being able to prevent the inclination of the cursor is improved.

Further, since the projections act to prevent the first moving cursor from being separated from the base plate according to this construction, separation of the first and second guiding portions and the first and second guidable portions is prevented. As a result, an effect of preventing separation of the first and second guiding portions and the first and second guidable portions is increased.

Note that the pinions 761, 762 only have to be supported on the coupling shaft 76 while being spaced apart from each other, and the coupled positions of the pinions 761, 762 to the coupling shaft 76 are not limited. However, it is preferable in terms of improving the effect of preventing the inclination of the cursor to arrange the pinions 761, 762 such that a center position A of the width cursor 71*a* in the feeding direction is located between the pinions 761, 762.

According to this construction, the first and the second guidable portions are arranged at positions distant from the center of the first moving cursor toward one and the other ends and the movement amounts of the first moving cursor on the base plate are equal at these positions. Thus, a force trying to parallelly move the first moving cursor is produced in a well-balanced manner, with the result that an effect of reducing the inclination of the cursor is increased.

Further, although the racks 921*a*, 921*b* (first rack) are shown as an example of the first guiding portion, the racks 922*a*, 922*b* (second rack) are shown as an example of the second guiding portion, the pinion 761 (first pinion) is shown as an example of the first guidable portion, the pinion 762 (second pinion) is shown as an example of the second guidable portion and the coupling shaft 76 is shown as an example of a synchronizing member, the first and second guiding portions are not limited to the racks, the first and second guidable portions are not limited to the pinions and the synchronizing member is not limited to the coupling shaft.

For example, a plurality of small projections may be formed in a row at regular intervals in the direction perpendicular to the feeding direction of the sheets P on the upper surface of the base plate 73 as the first guiding portion, projections arranged in a row parallel to the first guiding portion are formed on the upper surface of the base plate 73 as the second guiding portion, and arrangement intervals of the projection rows may be set to be equal between the first and second guiding portions.

The moving cursor may include a first claw member to be fitted into recesses between the projections of the first guiding portion as the first guidable portion and a second claw member to be fitted into recesses between the projections of the second guiding portion as the second guidable portion. The first and second claw members are held, for example, by elastic holding members. When the moving cursor is slid in the direction perpendicular to the feeding direction of the sheets P, the first and second claw members move on the first and second guiding portions while being successively and repeatedly fitted into the recesses and moving over the projections.

A coupling bar for synchronizing movements of the first and second claw members to be fitted into the recesses and move over the projections may be provided as the synchronizing member. This causes the first and second claw members to move over the projections in synchronization when the moving cursor is slid in the direction perpendicular to the feeding direction of the sheets P. As a result, the movement amount of the moving cursor at the position where the first claw member is attached and that of the moving cursor at the position where the second claw member is attached become equal, wherefore a possibility of inclining the moving cursor is reduced in sliding the moving cursor.

That is, according to this construction, when the user slides the first moving cursor in one direction, the first and second guidable portions move while being guided by the first and second guiding portions. At this time, since movements of the first and second guidable portions are synchronized by the synchronizing member, the first and second guidable portions move in parallel. Since the first and second guidable portions are attached to the first moving cursor while being spaced apart, the first moving cursor parallelly moves when the first and second guidable portions move in parallel on the base plate. As a result, the possibility of inclining the cursor is reduced.

Figure 8:
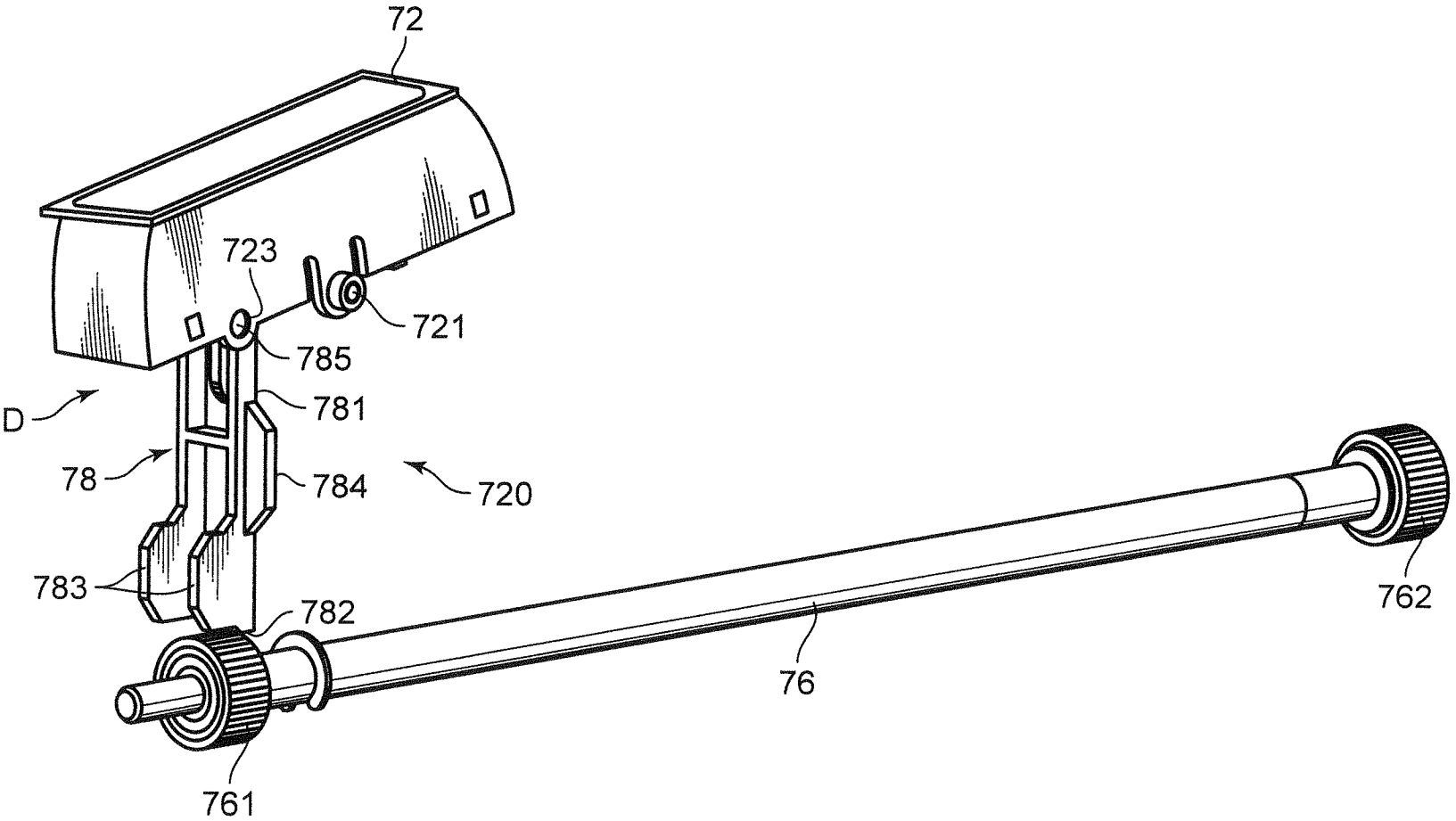
FIG. 8 is a perspective view showing an exemplary construction of a locking portion provided in the width cursor.
Figure 9:
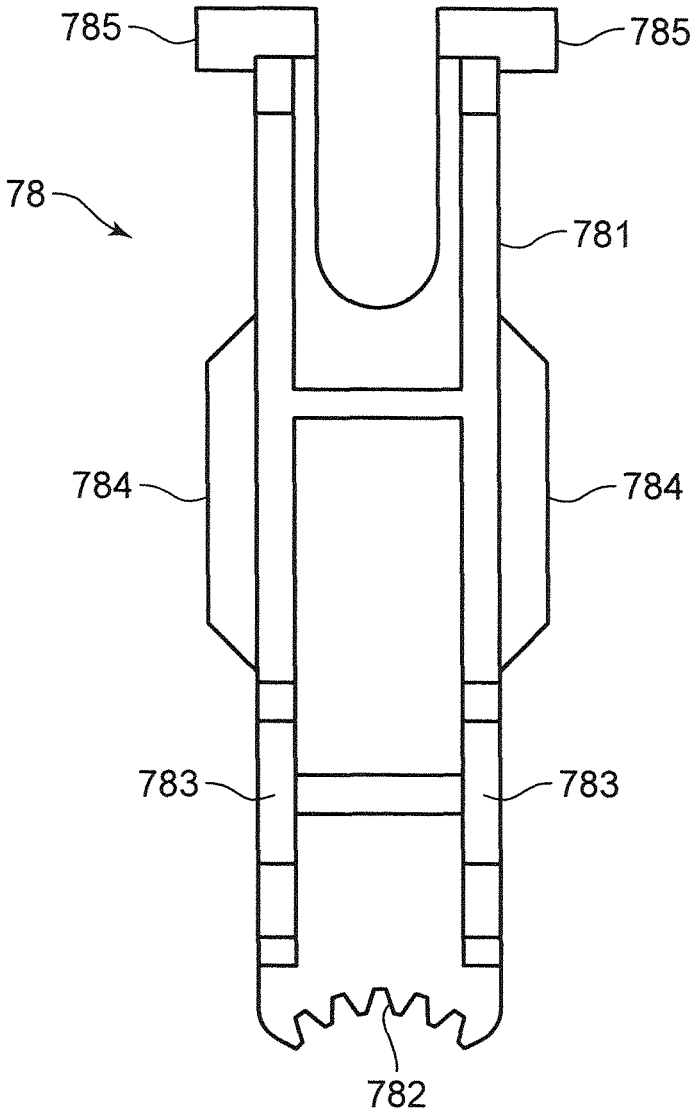
FIG. 9 is a front view showing a locking member.
Figure 10:
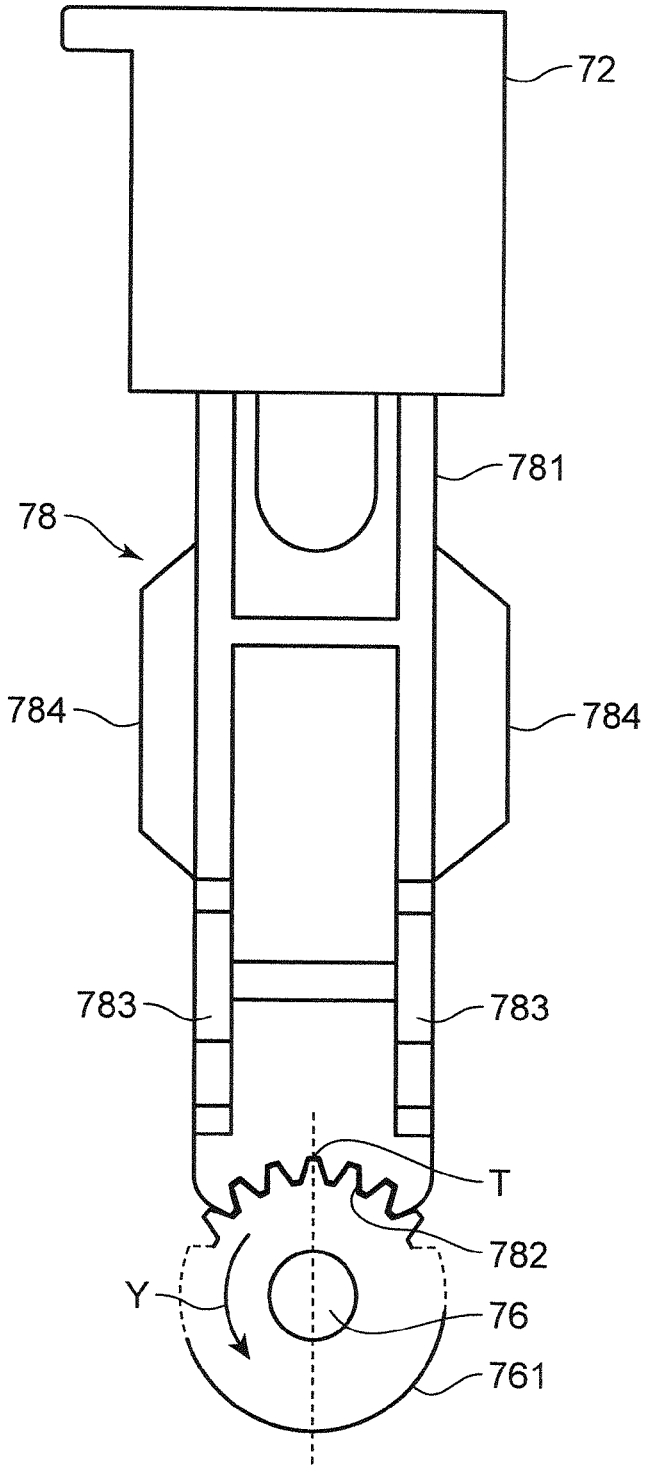
FIG. 10 is a front view showing a locked state of the locking member and a pinion.

FIGS. 8, 9 and 10 are diagrams showing an exemplary construction of the locking portion 720. The locking portion 720 includes a switching knob 72 (switching member) and a locking member 78. The switching knob 72 is a box-like member substantially in the form of a rectangular parallelepiped with an open lower surface. Bosses 721, 721 projecting toward the walls 711*a*, 712*a* are formed at the opposite sides of a bottom part of the switching knob 72 substantially near the center. The bosses 721 are fitted in unillustrated recesses formed in the walls 711*a*, 712*a*. In this way, the switching knob 72 is rotatably supported by the bosses 721 and rotatable about the bosses 721.

Boss holes 723, 723 are formed in the opposite side wall surfaces of the switching knob 72 at positions spaced apart from and upstream of the bosses 721, 721 in the sheet feeding direction.

A projection 722 projecting toward the wall 712*a* is provided on a wall surface of the switching knob 72 facing the wall 712*a* (see FIG. 7). The wall 712*a* is formed with holes 74, 75 spaced apart in a vertical direction.

When an upstream end B of the upper surface of the switching knob 72 in the sheet feeding direction is pushed down, the switching knob 72 rotates to raise a downstream end C of the upper surface of the switching knob 72 in the sheet feeding direction and the projection 722 is fitted into the upper hole 74 to lock the switching knob 72. A state where the projection 722 is fitted in the upper hole 74 and the switching knob 72 is locked is called a locking posture below.

On the other hand, when the downstream end C of the upper surface of the switching knob 72 in the sheet feeding direction is pushed down, the switching knob 72 rotates to lower the downstream end C and the projection 722 is fitted into the lower hole 75 to lock the switching knob 72. A state where the projection 722 is fitted in the lower hole 75 and the switching knob 72 is locked is called an unlocking posture below.

FIG. 9 is an outer shape diagram showing an exemplary shape of the locking member 78. The locking member 78 includes a plate-like member 781 long substantially in the vertical direction. Cylindrical bosses 785, 785 projecting toward the opposite sides in a direction (lateral direction in FIG. 9) perpendicular to a thickness direction are provided at the upper end of the plate-like member 781. The bosses 785, 785 are fitted into the boss holes 723, 723. In this way, the locking member 78 is rotatable about the bosses 785, 785.

A tooth portion 782 to be engaged with gear teeth on the peripheral surface of the pinion 761 from above are formed at the lower end of the plate-like member 781. Guide members 783, 783 projecting toward the upstream side in the sheet feeding direction are formed above the tooth portion 782. Plate-like members 715, 716 formed to sandwich the locking member 78 from the opposite sides and extending in the vertical direction are mounted between the walls 711*a*, 712*a* of the width cursor 71*a* (FIG. 7). The guide members 783, 783 position the tooth portion 782 on the peripheral surface of the pinion 761 by coming into contact with the plate-like member 715.

Further, guide members 784, 784 projecting toward the opposite sides in the direction (lateral direction in FIG. 9) perpendicular to the thickness direction are formed at lateral end portions of the plate-like member 781 near a substantially longitudinal center. The guide members 784, 784 are held in contact with the inner wall surfaces of the walls 711*a*, 712*a* of the width cursor 71*a*.

Unillustrated guide grooves extending upward from the pinion 761 are formed in the inner wall surfaces of the walls 711*a*, 712*a*, and the guide members 784, 784 are slidably fitted into these guide grooves.

When the switching knob 72 is set to the unlocking posture, the boss holes 723, 723 are moved upward and the bosses 785, 785 are pulled up, whereby the locking member 78 is moved upward to separate the tooth portion 782 and the pinion 761. In this state, the pinions 761, 762 are freely rotatable, with the result that the width cursors 71*a*, 71*b* also become slidable.

On the other hand, when the switching knob 72 is set to the locking posture, the boss holes 723, 723 are moved downward and the bosses 785, 785 are pushed down, whereby the locking member 78 is lowered and the tooth portion 782 is engaged with the pinion 761 from above. FIG. 10 is a diagram of the locking portion 720 when viewed in a direction of an arrow D, i.e. from the left side in FIG. 8 and shows a state where the tooth portion 782 is engaged in the case where the switching knob 72 is in the locking posture. Note that although gear teeth are formed on the entire periphery of the pinion 761, some teeth are not shown in FIG. 10.

In a state where the switching knob 72 is set in the locking posture, the rotation of the pinion 761 about the shaft is locked by the tooth portion 782. Then, the rotation of the pinion 762 coupled to the pinion 761 by the coupling shaft 76 is also locked. As a result, the pinions 761, 762 are fixed to the racks 921*a*, 922*a* and a sliding movement of the width cursor 71*a* is prevented.

Since the copier 100 shown in FIG. 1 is so constructed that the feeding direction of a sheet P from the sheet cassette 6 is substantially perpendicular to the mounting and detaching directions of the sheet cassette 6 into and from the apparatus main body, a large impact (impact in the direction of the arrow R) acts on the rear width cursor 71*a* located at the back side of the sheet tray 62 in an inserting direction due to an inertial force of sheets P stacked and stored in the sheet cassette 6 in mounting the sheet cassette 6 into the apparatus main body.

Thus, the width cursor 71*a* may be moved by the inertial force of the sheets P. However, since the width cursor 71*a* includes the locking portion 720, a possibility of moving the width cursor 71*a* can be prevented by the user operating the switching knob 72 and setting it to the locking posture even if the inertial force of the sheets P acts on the width cursor 71*a*.

According to this construction, a movement of at least one of the first and second guidable portions is locked by the locking portion. Since movements of the first and second guidable portions are synchronized by the synchronizing member, the movements of the first and second guidable portions are both stopped if the movement of at least one of the first and second guidable portions is locked. In this way, a possibility of sliding the first moving cursor relative to the base plate can be reduced.

Further, according to this construction, when the locking member is positioned to be engaged with at least one pinion, the rotation of the first and second pinions about the shaft is stopped. When the locking member is positioned to be spaced apart from the at least one pinion, the rotation of the first and second pinions about the shaft is possible. Accordingly, a state where the sliding movement of the moving cursor is prevented and a state where the sliding movement of the moving cursor is enabled can be switched by the switching member.

Further, in the case of mounting the stopper member 77 on the rear width cursor 71*a* located at the back side of the sheet tray 62 in the inserting direction, the user needs to operate the stopper member 77 by inserting his hand to the back side beyond the width cursor 71*a*. Thus, this operation is very difficult. However, since the switching knob 72 is provided at the upper part of the width cursor 71*a*, operability is improved.

That is, according to this construction, user operability is improved since the switching member to be operated by the user is arranged at the upper part of the first moving cursor.

Further, since the locking portion 720 is provided above the pinion 761, the switching knob 72 can be easily provided at the upper part of the width cursor 71*a*.

Furthermore, since the locking portion 720 suppresses the movement of the width cursor 71*a* utilizing the pinion 761 and the rack 921*a* provided to prevent the inclination of the width cursor 71*a* with respect to the sheet feeding direction, it is not necessary to separately provide the stopper member 77 and the engaging portion of the base plate 73 only to suppress the movement of the width cursor 71*a*.

Figure 11:
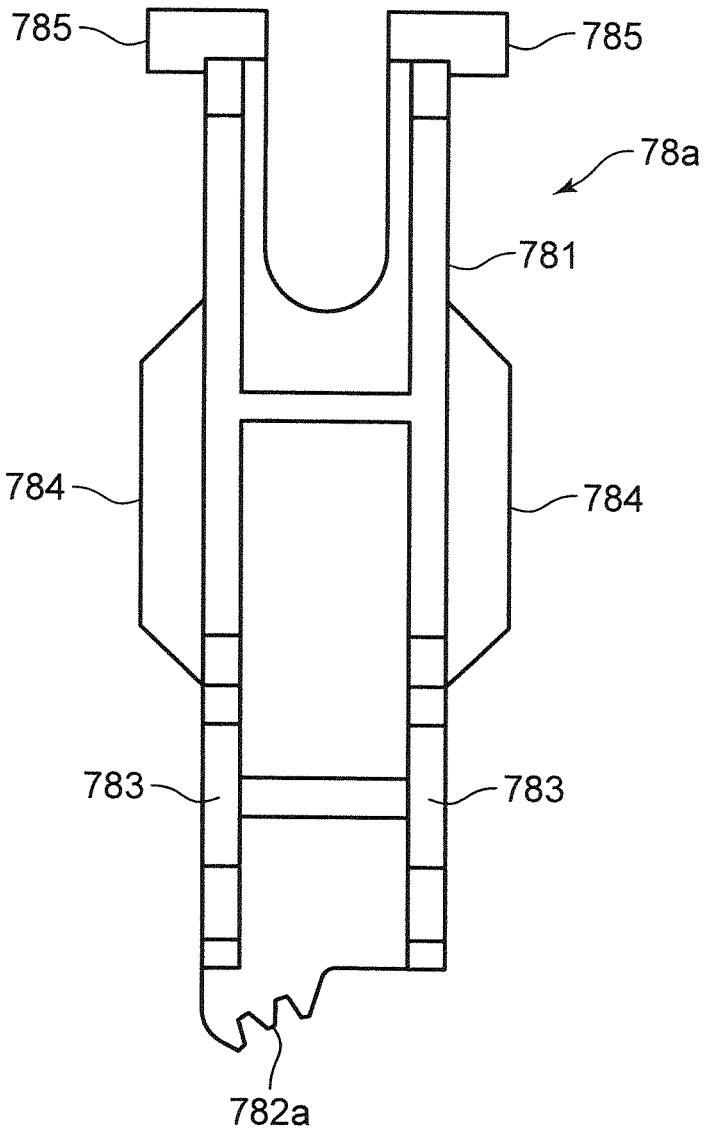
FIG. 11 is a front view showing another locking member.
Figure 12:
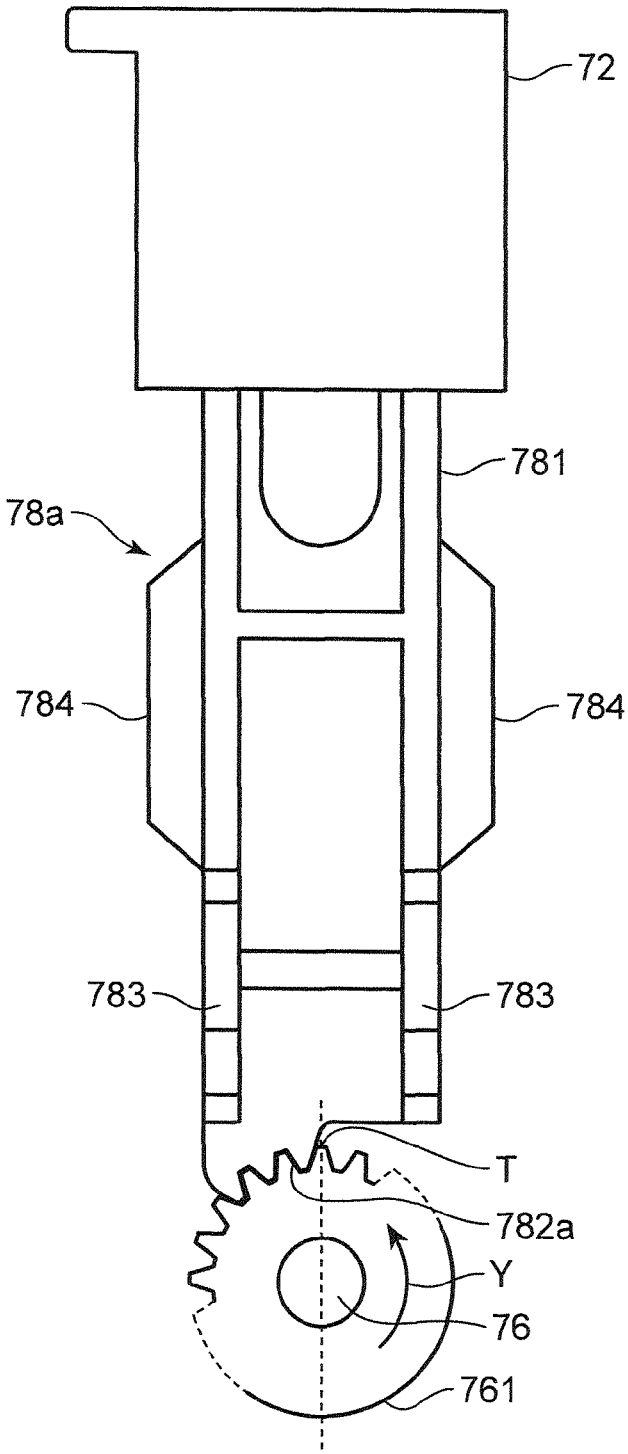
FIG. 12 is a front view showing a locked state of the other locking member and the pinion.

Note that a locking member 78*a* shown in FIGS. 11 and 12 may be used instead of the locking member 78. The locking member 78*a* differs from the locking portion 78 in including a tooth portion 782*a* instead of the tooth portion 782.

The locking member 78*a* includes the tooth portion 782*a* to be engaged with the teeth of the pinion 761 located downstream of a top T of the pinion 761 in a rotation direction Y of the pinion 761 when the width cursor 71*a* is moved in the direction of the arrow R (direction to move the width cursors 71*a*, 71*b* away from each other) and does not include teeth to be engaged with the teeth of the pinion 761 located upstream of the top T of the pinion 761.

Here, with reference to FIG. 10, when a force trying to move the width cursor 71*a* in the direction of the arrow R acts on the width cursor 71*a* due to an inertial force of stacked sheets P and produces a force to rotate the pinion 761 in the rotation direction Y in a state where the locking member 78 is engaged with the pinion 761, the teeth of the pinion 761 are engaged with the tooth portion 782 at a side downstream of the top T in the rotation direction Y and a force trying to pull the tooth portion 782 downward acts.

On the other hand, at a side upstream of the top T in the rotation direction Y, a gravity-defying force acts to push up the tooth portion 782 from the teeth of the pinion 761. Thus, an engaging force between the tooth portion 782 and the pinion 761 is weakened and the tooth portion 782 and the pinion 761 slip without being able to resist the inertial force of the sheets P and the width cursor 71*a* becomes more easily movable.

However, in the case of using the locking member 78*a* shown in FIG. 11, the teeth of the pinion 761 and the tooth portion 782*a* are engaged and a force acts to pull the tooth portion 782*a* downward to increase an engaging force between the teeth of the pinion 761 and the tooth portion 782*a* at the side downstream of the top T in the rotation direction Y even if a force is produced to rotate the pinion 761 in the rotation direction Y as shown in FIG. 12. On the other hand, since there are no teeth of the tooth portion 782*a* at the side upstream of the top T in the rotation direction Y, the engaging force between the tooth portion 782*a* and the pinion 761 is not weakened. As a result, a possibility that the width cursor 71*a* is moved by the inertial force of the sheets P can be reduced.

That is, when a sheet feeder is moved with sheets stored in the sheet feeder, an inertial moving force of the sheets acts in a direction to move a pair of cursors away from each other. At this time, at a side downstream of the top of a pinion in a direction in which the pinion of a moving cursor tries to rotate, a rotational force acts in a direction in which the pinion pulls down a locking member, i.e. in a direction to strengthen an engaging force between the pinion and the locking member. On the other hand, if there are teeth at a side upstream of the top of the pinion in the direction in which the pinion of the moving cursor tries to rotate, a rotational force acts in a direction in which the pinion pulls up the locking member against gravitation, i.e. in a direction to weaken the engaging force between the pinion and the locking member. Accordingly, the engaging force between the pinion and the locking member can be strengthened by providing the locking member with no teeth to be engaged with the teeth of the pinion upstream of the top of the pinion.

Note that although the example in which only the width cursor 71*a* includes the locking portion 720 has been shown, the width cursor 71*b* may also include the locking portion 720. Further, although the example in which the width cursors 71*a*, 71*b* are both moving cursors has been shown, either one of the width cursors 71*a*, 71*b* may be fixed to the base plate 73.

Further, although the example in which the sheet width regulating unit 63 is arranged in the sheet cassette 6 has been shown, the sheet width regulating unit 63 may be provided, for example, in the automatic document feeder 7 and used to regulate the width of a document. Further, the sheet width regulating unit 63 may also be used in an unillustrated manual feed tray.

Note that although the example in which the sheet width regulating unit 63 as an example of the sheet width regulating device according to the present disclosure is applied to the copier as an example of the image forming apparatus has been shown, application to printers, facsimile machines, complex machines of these and the like other than copiers is also possible without limitation to this.

Further, although the example in which the sheet feeder is applied to the copier constructed such that the mounting and detaching direction of the sheet cassette are substantially perpendicular to the feeding direction into the apparatus main body has been described in the above embodiment, the present disclosure is not limited to this and the above sheet width regulating device may be applied to a sheet feeder of a copier constructed such that mounting and detaching direction of a sheet cassette and a feeding direction into an apparatus main body are same, e.g. the sheet cassette is pulled out from the right side in FIG. 1.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A sheet width regulating device, comprising:

a base plate on which a sheet having one end and the other end parallel to each other is to be placed;

a regulating member which regulates one end of the sheet;

a first moving cursor which is a member for regulating the other end of the sheet, stands on an upper surface of the base plate and is movable in a way perpendicular to a direction along the other end of the sheet;

a first rack that extends in the way on the upper surface of the base plate;

a second rack that is spaced apart from and extends in parallel with the first rack;

a first pinion that is attached to the first moving cursor and engaged with the first rack;

a second pinion that is attached to the first moving cursor and engaged with the second rack; and a coupling shaft that rotates the first and second pinions simultaneously; wherein the first moving cursor further includes a locking portion for locking rotation of at least one of the first and second pinions about an axis of the pinion, and the locking portion includes:

a locking member engaged with a peripheral surface of the at least one pinion from above; and a switching member for switching a position of the locking member between a position where the locking member is engaged with the at least one pinion and a position where the locking member is spaced apart from the at least one pinion.

2. A sheet width regulating device according to claim 1, wherein the first and second pinions are so arranged that a central position of the first moving cursor in a direction along the other end is located between the first and second pinions.

3. A sheet width regulating device according to claim 1, wherein the first moving cursor further includes:

a first engaging portion which is provided near the first rack and engaged with the base plate slidably in a direction parallel with the first rack; and a second engaging portion which is provided near the second rack and engaged with the base plate slidably in a direction parallel with the second rack.

4. A sheet width regulating device according to claim 3, wherein the base plate is slidably engaged with the first engaging portion along a sliding direction parallel with the first rack near the first rack.

5. A sheet width regulating device according to claim 3, wherein the first engaging portion includes a projection projecting in a direction perpendicular to the sliding direction on a lower surface of the base plate.

6. A sheet width regulating device according to claim 1, wherein:

the regulating member is a second moving cursor which stands on the upper surface of the base plate and is movable in the way; and the sheet width regulating device further comprises a moving mechanism for moving the first and second cursors simultaneously in opposite directions along the way.

7. A sheet width regulating device according to claim 1, wherein the first moving cursor further includes a locking portion for locking at least one of the first and second pinions to prevent a movement of the at least one of the first and second pinions along the respective rack for engaging the at least one of the first and second pinions out of the first and second racks.

8. A sheet width regulating device according to claim 1, wherein the locking member includes a tooth to be engaged with teeth of the at least one pinion located downstream of a top of the at least one pinion in a rotation direction of the at least one pinion when the first moving cursor is moved in a direction away from the regulating member, but includes no tooth located upstream of the top of the at least one pinion.

9. A sheet width regulating device according to claim 1, wherein the switching member is a member, the position of which is switched according to a user's operation, and arranged at an upper part of the first moving cursor.

10. An image forming apparatus, comprising:

a sheet width regulating device according to claim 1; and an image forming unit for forming an image on a sheet fed from the sheet width regulating device.

* * * * *